US007987549B2

(12) United States Patent
Tam

(10) Patent No.: US 7,987,549 B2
(45) Date of Patent: Aug. 2, 2011

(54) VACUUM CLEANER WITH A MASSAGE HEAD

(76) Inventor: Yathung Tam, Hong Kong (CN)

( * ) Notice: Subject to any disclaimer, the term of this patent is extended or adjusted under 35 U.S.C. 154(b) by 355 days.

(21) Appl. No.: 12/043,680

(22) Filed: Mar. 6, 2008

(65) Prior Publication Data

US 2009/0031523 A1 Feb. 5, 2009

(30) Foreign Application Priority Data

Aug. 1, 2007 (CN) ..... 2007 2 0121921 U

(51) Int. Cl.

| | |
|---|---|
| ***A47L 5/00*** | (2006.01) |
| ***A47L 9/00*** | (2006.01) |
| ***A47L 9/04*** | (2006.01) |
| ***A47L 9/06*** | (2006.01) |
| ***A47L 13/00*** | (2006.01) |

(52) U.S. Cl. ..... 15/328; 15/364; 15/110

(58) Field of Classification Search ..... 15/328, 15/364, 110

See application file for complete search history.

(56) References Cited

U.S. PATENT DOCUMENTS 3,999,243 A * 12/1976 La Pour ..... 15/344

* cited by examiner

*Primary Examiner* — Bryan R Muller

(74) *Attorney, Agent, or Firm* — Michael G. Johnston; Moore & Van Allen PLLC

(57) ABSTRACT

The invention relates to a vacuum cleaner with a golf massage club, including a handle (4), a cleaner body (3) connected to the first end of the handle (4), and a suction head (1) connected to the head of the cleaner body (3), wherein a golf massage head (5) is connected to the second end of the handle (4). With the vacuum cleaner of the invention, the user can use the handle for human body massage when the vacuum cleaner is not in use. The vacuum cleaner of the invention is of compact structure and multiple functions.

10 Claims, 6 Drawing Sheets

VACUUM CLEANER WITH A MASSAGE HEAD

TECHNICAL FIELD

This invention relates to a vacuum cleaner with a golf massage club.

BACKGROUND

Along with the development of the cleaning industry, vacuum cleaners are made familiar to numerous customers. As limited by use sites, however, vacuum cleaners are commonly designed with an integrated structure. In order to reduce the occupying space, vacuum cleaners are usually quite short, thus they are only used to clear dust in open spaces, but not suitable for some narrow gaps.

Furthermore, the vacuum cleaners available in the market can only perform a single function, i.e., cleaning, and can not meet the needs of modern customers.

SUMMARY

This invention aims to provide a vacuum cleaner with a golf massage club. The inventive vacuum cleaner can be used for cleaning and massaging, and is convenient for storage.

According to the invention, a vacuum cleaner with the golf massage club is provided, which includes a suction head, a cleaner body and a handle. The suction head is connected to the head of the cleaner body, and a dust bin is arranged between the suction head and the head of the cleaner body. The cleaner body is provided with sockets for connecting with the handle at its tail.

In one embodiment, the head of the handle is of a Y-shaped structure which can be inserted into and connected with corresponding sockets at the tail of the cleaner body. One end of the Y-shaped structure is provided with a first electric cord hook and the other end thereof has a hook at its bottom. The handle rod is provided with several first massaging protrusions. The handle rod is provided with a second electric cord hook on the same side as where the first electric cord hook is arranged. Threads are formed at the tail of the rod in order to engage with the associated threads on the golf massage head.

In one embodiment, on the golf massage head there are several second massaging protrusions provided. Moreover, a ball-shaped soft body is provided on one side of the golf massage head, and the joint part between the soft body and the golf massage head is provided with a magnetic therapy cupping which runs through the center of golf massage head. A cover is provided at the open end of the magnetic therapy cupping, and a massage ball is provided on the cover.

In one embodiment, on one side of the upper end of the golf massage head there is a columnar structure, from the top of which a hemispheric projection extends. Furthermore, a plurality of massage rollers are provided at the bottom of the golf massage head, and a plurality of third massaging protrusions are provided on the massage rollers.

Preferably, four massage rollers are fixed to the bottom of the golf massage head by respective roller holders.

In one embodiment, on one side of the cleaner body a short grip is provided for user holding, while actuation buttons are provided on the other side of the cleaner body.

In one embodiment, a spring sheet is provided in the socket of the clean body. The spring sheet is of an M-shaped structure, and on one side at the middle of the spring sheet there is an upward protruding concave notch.

Preferably, the suction head of the invention can be a floor brush, a brush or a hose.

In one embodiment, a socket is provided at the front end of the hose.

In one embodiment, the hose is connected to a dust bin which is a sealed cavity. A first opening and a second opening are arranged at the top of the dust bin, the diameter of the latter being larger than that of the former. Moreover, the diameter of the first opening is substantially same as that of the hose.

A bin cover is provided at the top of the dust bin by a hinge. A pedal is provided at the lower wall of the dust bin for controlling the bin cover open or close. A plurality of, preferably four, wheels are provided at the bottom surface of the dust bin for movement.

In a preferable embodiment, the dust bin is connected to a herbal treatment device by means of a suck pipe, so that the smoke generated during treatment can be absorbed by the vacuum cleaner via the suck pipe. It is desirable for air cleaning indoors, especially in hospital. To increase the smoke collecting effect, an absorbent material can be provided on the inner wall of the dust bin.

According to the vacuum cleaner with the golf massage club of the invention, a golf massage head is provided on the handle, such that the user can use the handle for human body massage when the vacuum cleaner is not in use. In addition, the golf massage head can be screwed off, changing the handle into a clothes-airing pole, on which clothes can be hung.

DETAILED DESCRIPTION OF THE EMBODIMENTS

Detailed description of the invention will be given below with reference to the drawings and embodiments.

Figure 1:
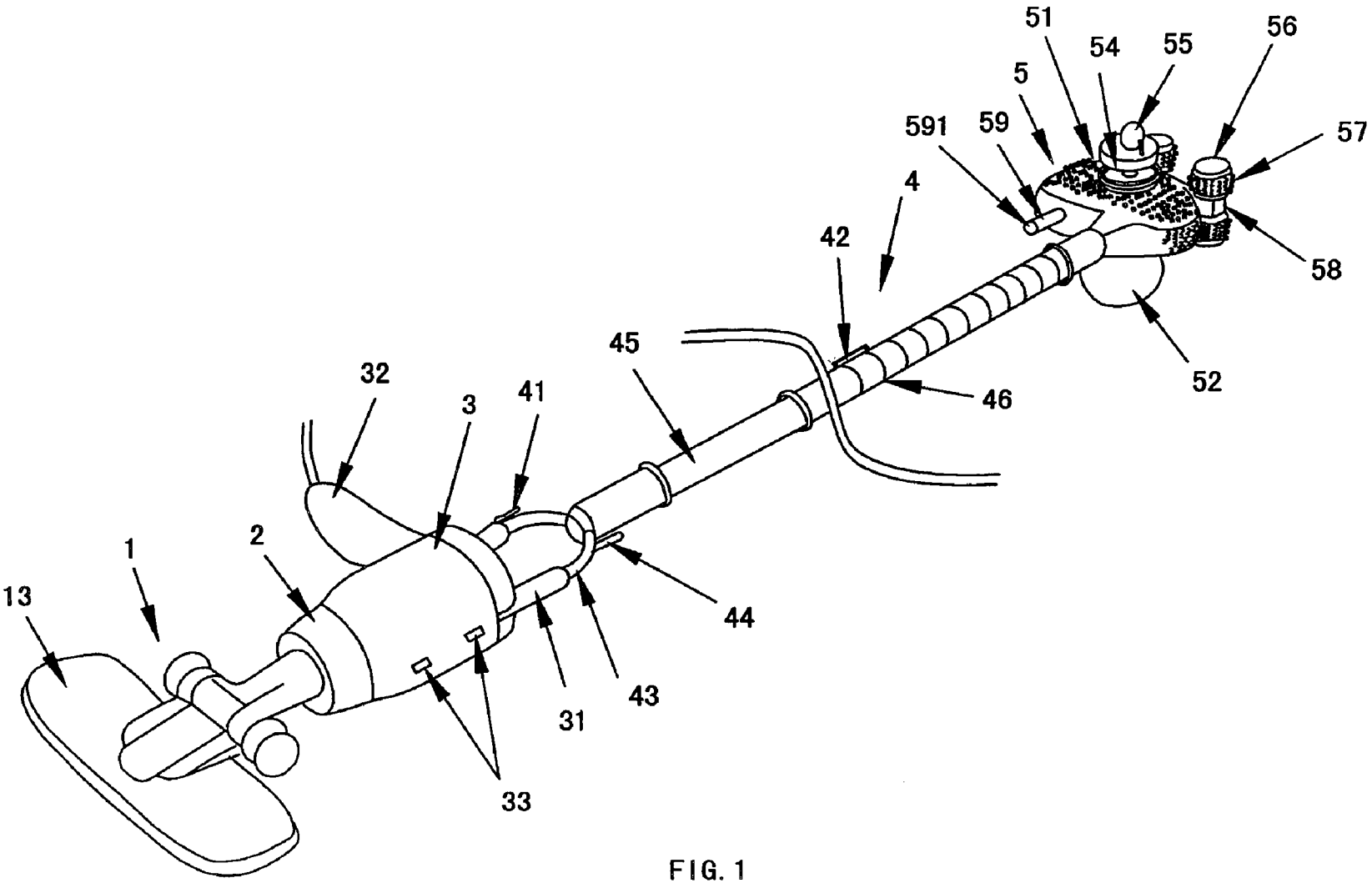
FIG. 1 shows the vacuum cleaner with a golf massage club according to the invention.
Figure 2:
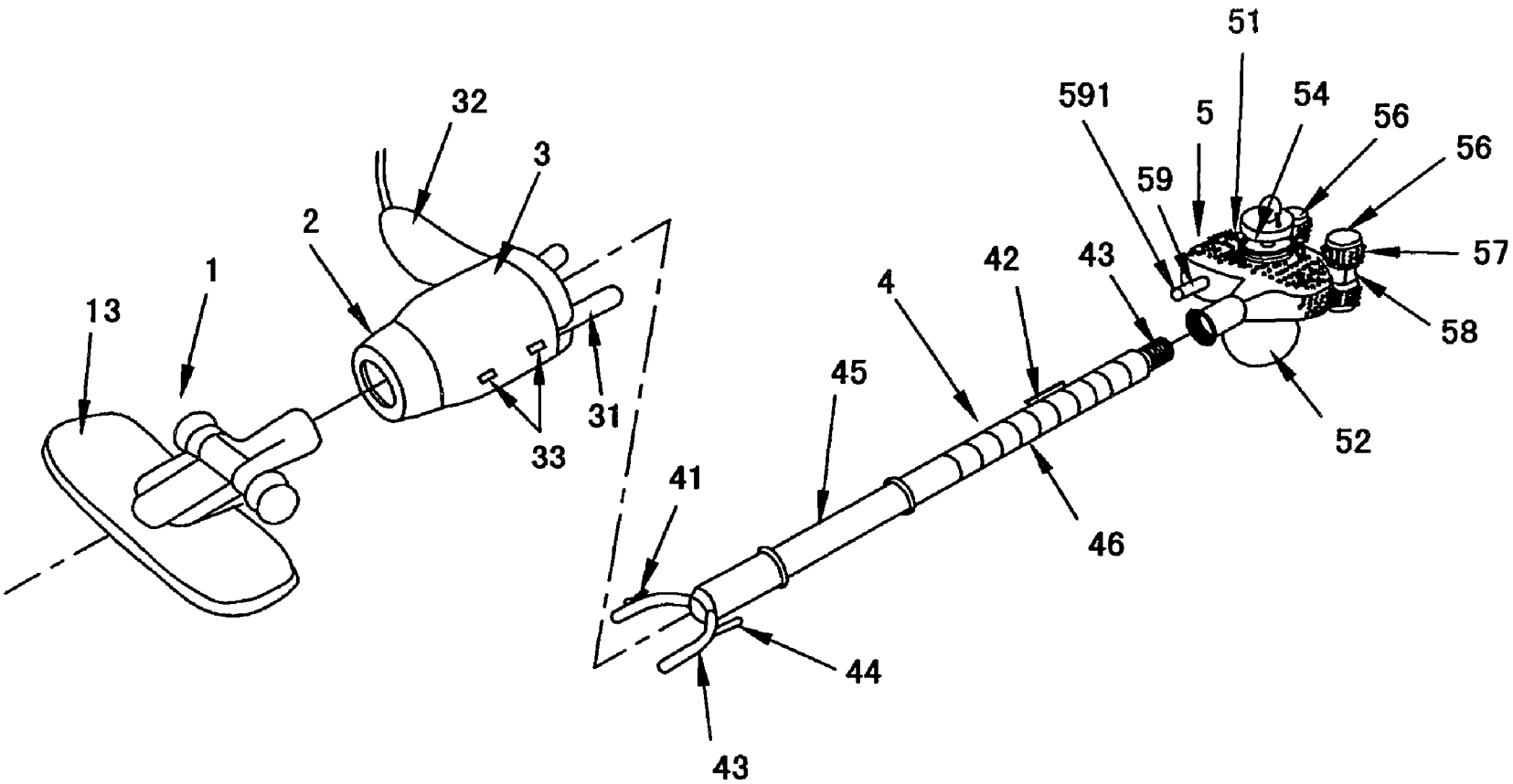
FIG. 2 is an explosive view of the vacuum cleaner.
Figure 7:
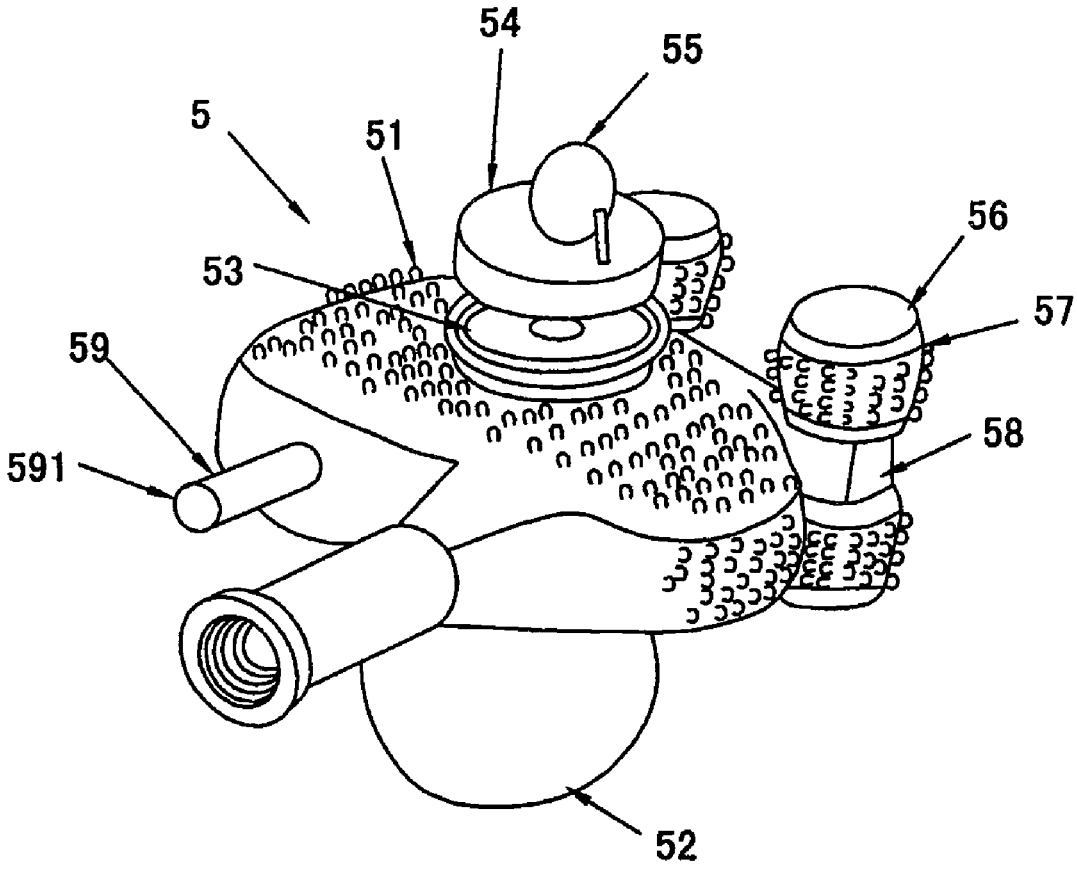
FIG. 7 shows the golf massage head of the invention.

As illustrated in FIGS. 1, 2 and 7, the vacuum cleaner with a golf massage club includes a suction head 1, a cleaner body 3 and a handle 4. The suction head 1 is connected to the head of the cleaner body 3, and a dust collection box 2 is arranged between the suction head 1 and the head of the cleaner body 3.

The cleaner body 3 is provided with a plurality of, preferably two, sockets 31 at the tail portion thereof. The two sockets 31 are connect to a head 43 of Y-shaped structure of the handle 4. At one end of the head 43 of Y-shaped structure there is a first electric cord hook 41, and at the other end of the head 43 there is a hook 44.

The handle rod 45 of the handle 4 is provided with several first massaging protrusions 46. On the same side of the handle rod 45 on which the first electric cord hook 41 is arranged there is a second electric cord hook 42 provided. Threads 47 are provided at the tail portion of the handle rod 45, and engage with corresponding threads of the golf massage head 5.

On the golf massage head 5 there are provided several second massaging protrusions 51. A ball-shaped soft body 52 is provided on one side of the golf massage head 5, and the joint part between the soft ball-shaped body 52 and the golf massage head 5 is provided with a magnetic therapy cupping 53, which runs through the center of the golf massage head 5. A cover 54 is provided at the open end of the magnetic therapy cupping 53, and a massage ball 55 are provided on the cover 54.

On one side of the upper end of the golf massage head 5 there is a column structure 59, and at the top of the columnar structure 59 a hemispheric projection 591 is provided. Four massage rollers 55 are provided at the bottom end of the golf massage head 5, and third massaging protrusions 57 are provided on each of the massage rollers 55. The massage rollers 55 are fixed to the bottom end of the golf massage head 5 by respective roller holders 58.

On one side of the cleaner body 3 a short grip 32 for user holding is provided, while two vertically arranged actuation buttons 33 are provided on the other side of the cleaner body 3. The suction head 1 connected to the front end of the cleaner body 3 can be a floor brush 13, for example.

Figure 6:
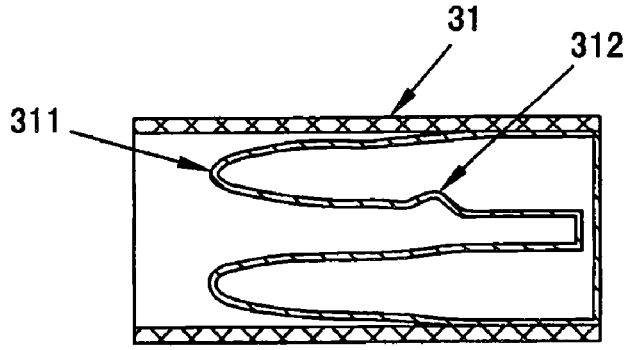
FIG. 6 shows the socket structure of the cleaner body.

As illustrated in FIG. 6, a spring sheet 311 is provided in the sockets 31 of the invention. The spring sheet 311 is formed in an M-shaped structure, and on one side at the middle portion of the spring sheet 311 there is a concave notch 312 extending upwardly.

In use, the suction head 1 is inserted into the dust collection box 2 at the front end of the cleaner body 3, and then both ends of the head 43 of Y-shaped structure at the front end of the handle 4 are respectively buckled into the two sockets 31 at the rear end of the cleaner body 3. Subsequently, the golf massage head 5 is connected with the threads 43 at the rear of the handle 4 by thread connection such that the assembly is completed. At this stage, the user can press the actuation button 33 so as to start cleaning.

During non-use stage, the cleaner body 3 can be taken off from the cleaner, and only with the handle it can be used to massage the human body. The magnetic therapy cupping 53 on the golf massage head 5 can also be used to perform some simple pain-reducing treatments. After use, the electric line can be wound between the first electric cord hook 41 and the second electric cord hook 42, thus preventing the electric cords from disorderly winding and knotting. Therefore, the storage of the cleaner is more convenient.

Figure 3:
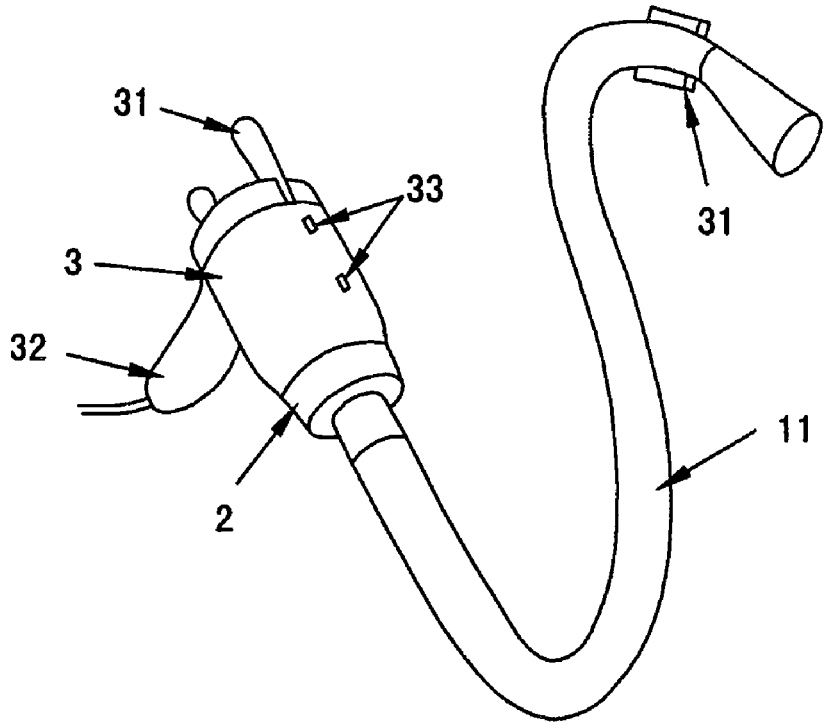
FIGS. 3 and 4 show the structure of the dust collection box and the cleaner body.
Figure 4:
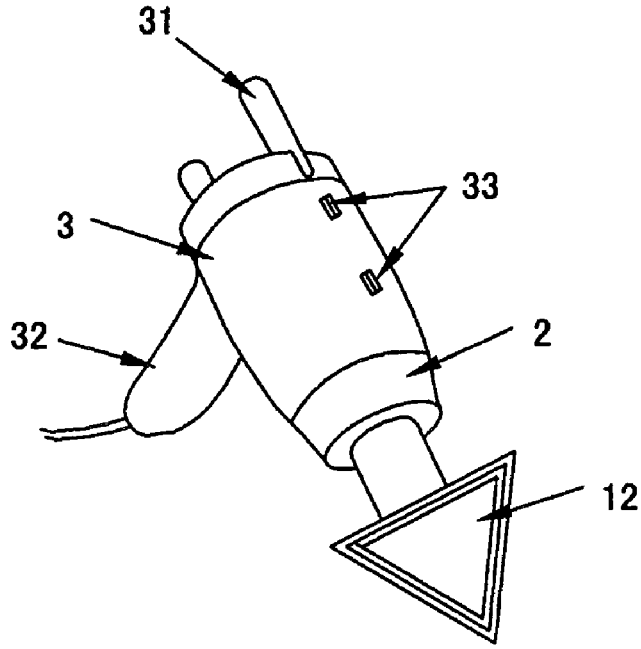

As illustrated in FIGS. 3 and 4, a hose 11 or a brush 12 can be inserted into the dust collection box 2 at the front end of the cleaner body 3. In this case, during use the user can hold the short grip 32 with one hand and take the hose 11 with the other hand, so as to clean some corners, computers, sofa, etc. Alternatively, the suction head 1 can be replaced with a brush 12 if necessary so as to carry out some suitable cleaning.

Figure 5:
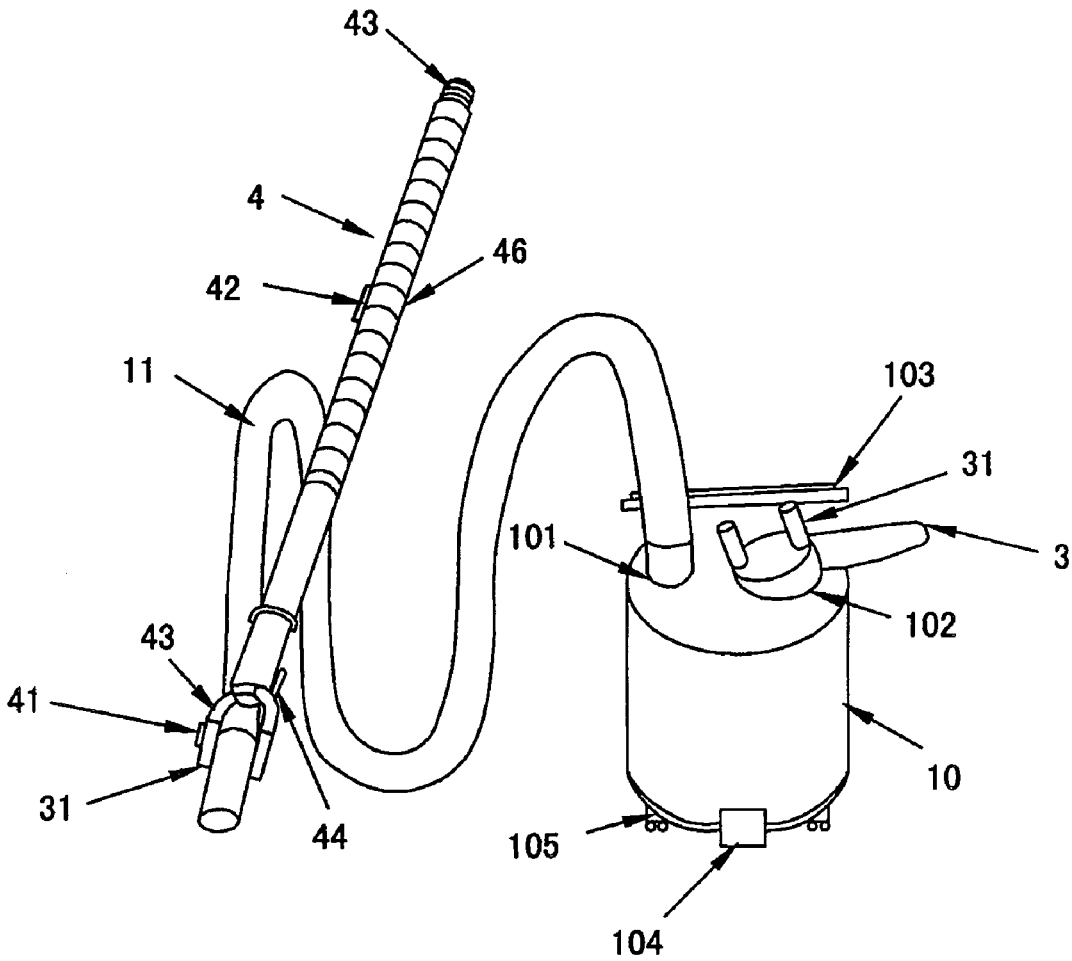
FIG. 5 shows the hose attached to a dust bin.

As illustrated in FIG. 5, the hose 11 can be connected to a dust bin 10, which has a sealed cavity and can be of a rectangular or columnar shape. A first opening 101 and a second opening 102 are arranged at the top of the dust bin 10, the diameter of the latter being larger than that of the former. Moreover, the diameter of the first opening 101 is substantially the same as that of the hose 11.

A bin cover 103 is provided at the top of the dust bin 10, and the tail end of the bin cover 103 is connected by a hinge with the rear of the dust bin 10. A pedal 104 is provided at the lower wall of the dust bin 10 and is connected with the dust bin cover 103. A plurality of, e.g., four, wheels 105 are provided at the bottom surface of the dust bin 105 for movement. The hose 11 is hermetically connected into the first opening 101, and the cleaner body 3 is hermetically connected in the second opening 102. Both free ends of the Y-shaped structure 43 of the handle 4 are buckled into the sockets 31 at the front end of the hose 11.

In use, the hose 11 and the cleaner body 3 are inserted into the first opening 101 and the second opening 102 respectively, then the golf massage head 5 is screwed off, and both ends of the Y-shaped structure 43 of the handle 4 are buckled into the two sockets 31 at the front end of the hose 11. At this stage, the user can hold the handle with hands and turn on the vacuum cleaner without bending.

Figure 8:
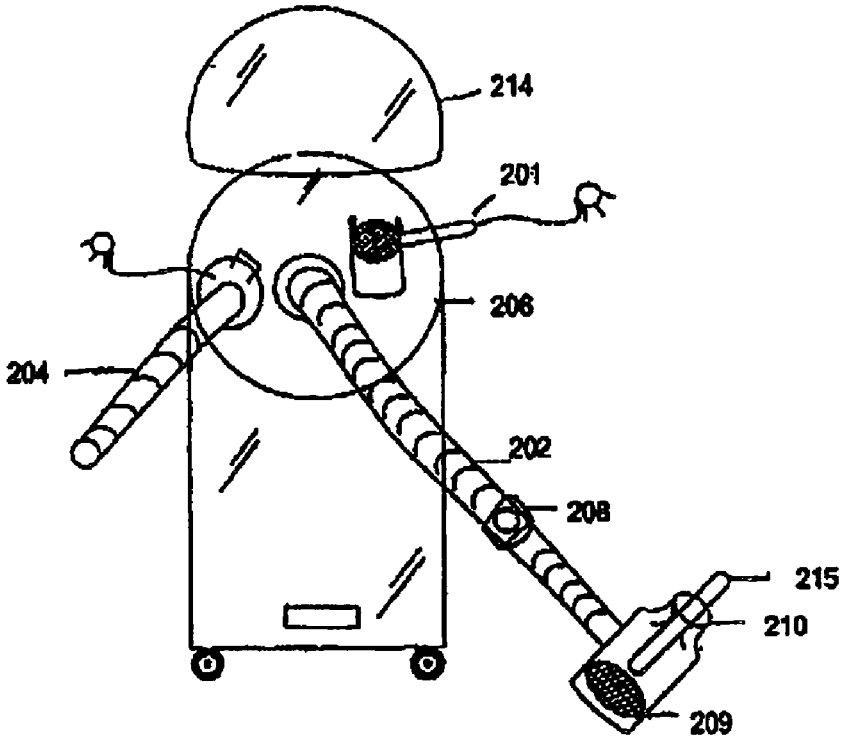
FIGS. 8 and 9 show the use of the vacuum cleaner in smoking collection.
Figure 9:
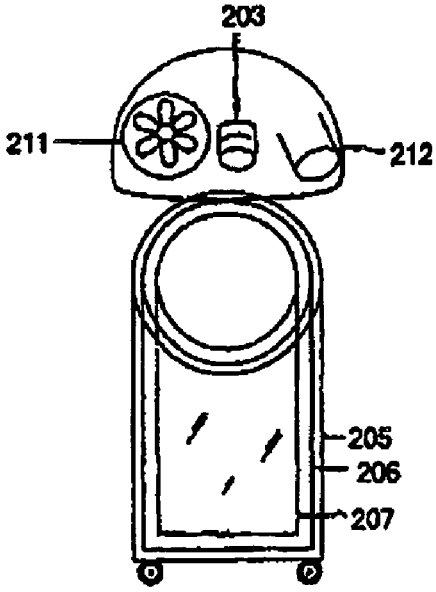

FIGS. 8 and 9 show the use of the vacuum cleaner in smoking collection. As shown, the dust bin 206 can be connected to the vacuum cleaner of the invention, a suction pipe 202 and a discharge fan (not shown, which is connected to the free end of the pipe 204) through a hole 212, a hole 203 and a hole 211 respectively. The suction pipe 202 is connected to a herbal treatment device 210 through a coupling 208.

The herbal treatment device 210 is in form of bottle, into which the herbal curative, e.g., strip 215 made of wormwood, can be inserted. The wormwood strip 215 can be burned and warm the acupuncture points of human bodies, so that a herbal treatment effect can be obtained. According to the invention, the smoke generated during treatment can be sucked into the dust bin 206 through the suction pipe 202 by means of the vacuum cleaner. It is desirable for air cleaning indoors, especially in hospital.

In one embodiment, a grid 209 is provided within the herbal treatment device 210 for collecting the ash burned from the wormwood strip 215. Moreover, for increasing the smoke collecting effect, an absorbent material 207, e.g., sponge, paper or carbon, can be provided on the inner wall of the dust bin. To facilitate cleaning, the absorbent material 207 can be provided in a removable housing 208, which is located in the dust bin 206. The smoke can be vented outdoors with the help of the discharge fan.

The vacuum cleaner with a golf massage head club according to the invention is provided with a golf massage head on its handle, enabling to use the handle for human body massage when the vacuum cleaner is not in use. In addition, the golf massage head can be screwed off, changing the handle into a clothes-airing pole, on which clothes can be hung.

The invention claimed is:

1. A vacuum cleaner, comprising:

a handle (4) having a first end and a second end, the first end of the handle (4) forming a Y-shaped structure (43) including two free ends, a cleaner body (3) for producing suction pressure, the cleaner body (3) having a pair of sockets (31) for receiving the free ends of the Y-shaped structure for connecting the cleaner body (3) to the first end of the handle (4), a suction head (1) having an inlet for collecting debris, the suction head (1) connected to the cleaner body (3), a massage head (5) connected to the second end of the handle (4), and a ball-shaped soft body (52) provided on a first side of the massage head (5).

2. The vacuum cleaner according to claim 1, wherein the Y-shaped structure (43) is provided with a first electric cord hook (41), and the handle (4) is provided with a second electric cord hook (42) longitudinally spaced from and on the same side as where the first electric cord hook (41) is provided for cooperating with the first electric cord hook (41) so as to fix the electric cord.

3. The vacuum cleaner according to claim 1, further comprising threads (43) provided at the second end of the handle (4) for connecting with the massage head (5).

4. The vacuum cleaner according to claim 1, further comprising a plurality of first massaging protrusions (46) on the handle, and the massage head (5) provided with a plurality of second massaging protrusions (51).

5. The vacuum cleaner according to claim 1, further comprising a columnar structure (59) provided on the massage head (5) adjacent to the handle (4), and a half-ball shaped projection (591) extending from the end of the columnar structure.

6. The vacuum cleaner according to claim 1, further comprising a plurality of massage rollers (55) provided on the massage head, and massaging protrusions (57) provided on the massage rollers.

7. The vacuum cleaner according to claim 6, wherein the plurality of massage rollers (55) are fixed on the massage head by respective roller holders (58).

8. The vacuum cleaner according to claim 1, wherein a short grip (32) for user holding is provided on the cleaner body (3), and actuation buttons (33) are provided on another side of the cleaner body.

9. The vacuum cleaner according to claim 1, further comprising a spring sheet (311) of M-shaped structure placed within each of the sockets (31), one side at the middle of each of the spring sheets (311) defining an upwardly protruding concave notch (312).

10. The vacuum cleaner according to claim 1, wherein the suction head (1) is selected from a group consisting of a floor brush (13), a fur brush (12) and a hose (11).

* * * * *